United States Patent [19]

Viessmann

[11] 4,242,987

[45] Jan. 6, 1981

[54] CONNECTING ARRANGEMENT FOR A HEATING BOILER

[76] Inventor: Hans Viessmann, Im Hain, 3559 Battenberg Eder, Fed. Rep. of Germany

[21] Appl. No.: 923,200

[22] Filed: Jul. 10, 1978

[30] Foreign Application Priority Data

Jul. 12, 1977 [DE] Fed. Rep. of Germany ..... 2731357
Dec. 27, 1977 [DE] Fed. Rep. of Germany ..... 2758296

[51] Int. Cl.[3] ..... F22B 9/00

[52] U.S. Cl. ..... 122/44 A; 122/500; 122/511

[58] Field of Search ..... 122/44 R, 110, 47, 500, 122/511; 126/391; 29/510, 525

[56] References Cited

U.S. PATENT DOCUMENTS

| | | | |
|---|---|---|---|
| 553,076 | 1/1896 | Roney | 122/500 |
| 693,298 | 2/1902 | Middleton | 122/511 |
| 730,338 | 6/1903 | Bower | 122/44 R |
| 731,194 | 6/1903 | Lovekin | 122/44 R |
| 1,205,037 | 11/1916 | Shepard | 122/44 R |
| 1,435,010 | 11/1922 | Lachman | 122/511 |

*Primary Examiner*—Edward G. Favors
*Attorney, Agent, or Firm*—Thomas R. Morrison

[57] ABSTRACT

Connecting arrangement for a heating boiler, in whose water-bearing sheet-steel housing is arranged an installation casting consisting of a combustion chamber and fuel-gas ducts.

For having a good and simple connection between the sheet-steel housing and the installation casting the improvement consists in that the front and rear wall of the sheet-steel housing are provided with an access opening and the opening edges are bent in the form of a collar, the inside diameter of the collar being rather smaller than the outside diameter of the seating faces of the installation casting and the front and rear wall being connected to the seating faces by a press fit.

13 Claims, 7 Drawing Figures

Fig.1
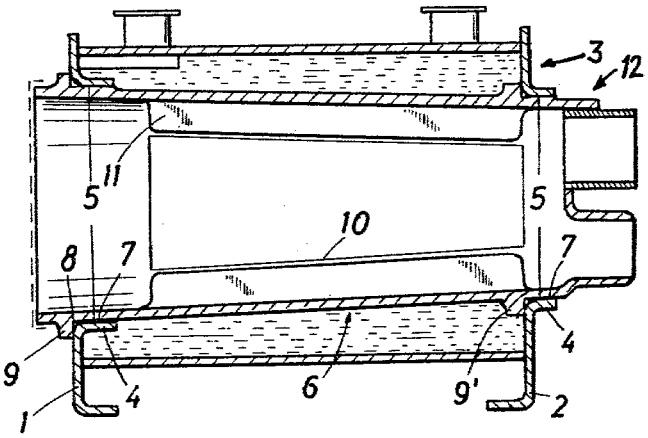
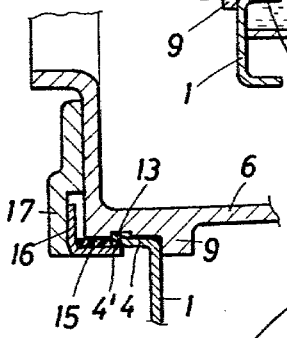
Fig.3
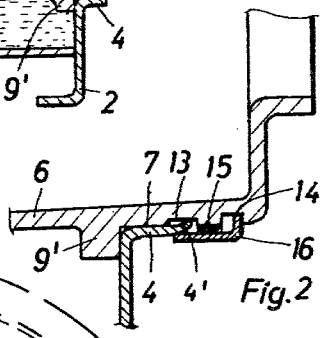
Fig.2
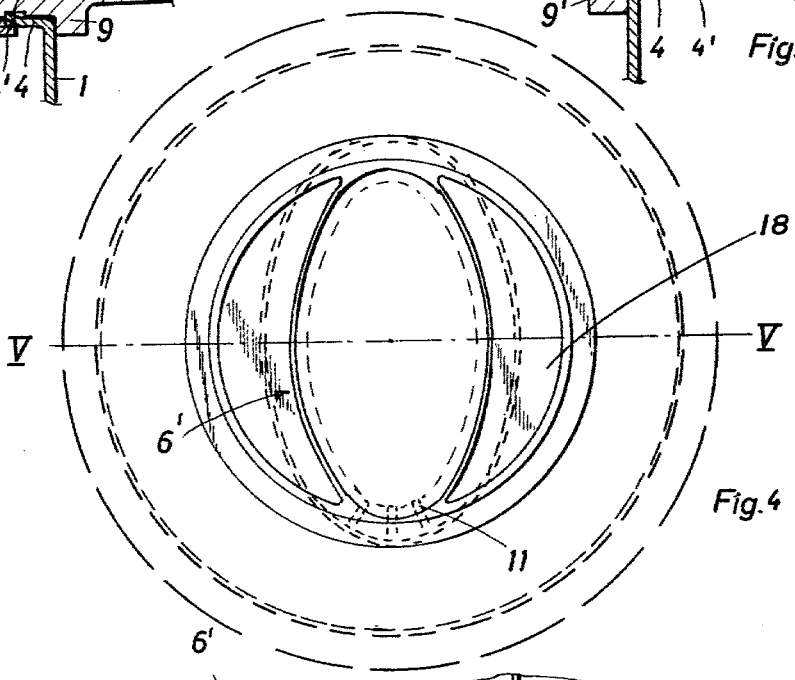
Fig.4
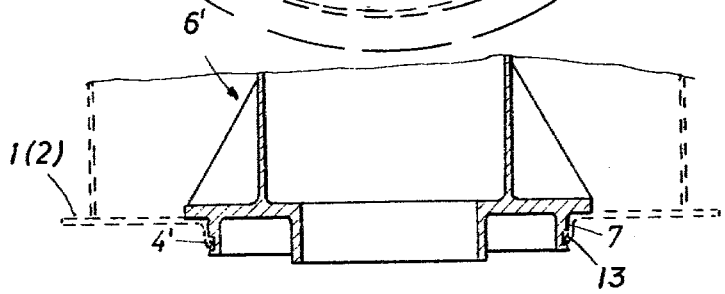
Fig.5

CONNECTING ARRANGEMENT FOR A HEATING BOILER

BACKGROUND OF THE INVENTION

The invention relates to a connecting arrangement for a heating boiler, in whose water-bearing sheet-steel housing is arranged an installation casting consisting of a combustion chamber and fuel-gas ducts.

A heating boiler is known from GB-PS 1,448,670, in which the flame-bearing and gas-bearing parts represent a self-contained installation unit which is to be introduced into a water-bearing outer housing and which is made from cast material with cast-on flange rings and is screwed in a sealed manner to adjacent flanges, although this results in a very expensive connection which may also be liable to leakage.

SUMMARY OF THE INVENTION

Therefore, the invention is based on the problem of eliminating these disadvantages, i.e., it is the object of the invention to provide a connecting arrangement for a heating boiler of the above-mentioned type, which, on the one hand, meets tightness requirements and, on the other hand, can be manufactured with the lowest production expenditure possible.

This problem is solved according to the invention with a connecting arrangement according to the invention by the fact that the front and rear walls of the sheet-steel housing are provided with an access opening and the opening edges thereof are bent in the form of a collar, the inside diameter of the collar being rather smaller than the outside diameter of the seating face of the installation casting and the front and rear walls being connected to the seating faces by a press fit.

Advantageous developments consist in that the seating faces of the installation casting are made stripped smooth and in that between the seating faces and the opening edges there is provided a lubricant and packing agent, such as heat-resistant and liquid-resistant cement or the like.

The connecting arrangement can also be made in such a way that the seating faces are provided on the end sides of the installation casting with, on the one hand, stop collars and, on the other hand, annular grooves, the opening edges of the front and rear walls being engaged into the annular grooves.

Due to the solution according to the invention, therefore, welding or soldering of the parts of different materials can be omitted completely and yet a tight, form-locking and force-locking connection is obtained, which is much less expensive than a welded, soldered or even flanged connection, although in this special case the latter could be manufactured with present means only at high cost and with considerable labour and would, nevertheless, not be sufficiently secure to prevent the seams from possible rupture owing to thermal stresses.

The detailed internal design of the installation casting is of no importance; it is substantial only that the installation casting represents a self-contained structure onto which the connecting walls are pressed from outside and can then be completed into an enclosed sheet-steel housing, which can, again be carried out with conventional welding measures. Tests have shown that the connecting arrangement according to the invention also satisfies at once the pressure condition to be taken into account in heating boilers.

BRIEF DESCRIPTION OF THE DRAWINGS

For a better understanding of the invention the connecting arrangement according to the invention and further forms a construction, as derived from the subclaims, are explained in detail hereinafter by reference to drawings of embodiments, installation casting clamped on both sides into connecting walls of sheet-steel being taken as a basis, although the use of the connecting arrangement with clamping of the installation casting on one side only is not excluded.

FIG. 1 is a longitudinal section through a heating boiler with the connecting arrangement;

FIG. 2 is a section through the connecting arrangement at the outlet end of the installation casting in a special form of construction;

FIG. 3 is a section through the connecting arrangement at the burner end of a heating boiler in a special form of construction;

FIG. 4 is a front view of an installation casting having an oval cross section;

FIG. 5 is a partial section along the line V—V in FIG. 4;

DESCRIPTION OF THE PREFERRED EMBODIMENTS

Figure 6:
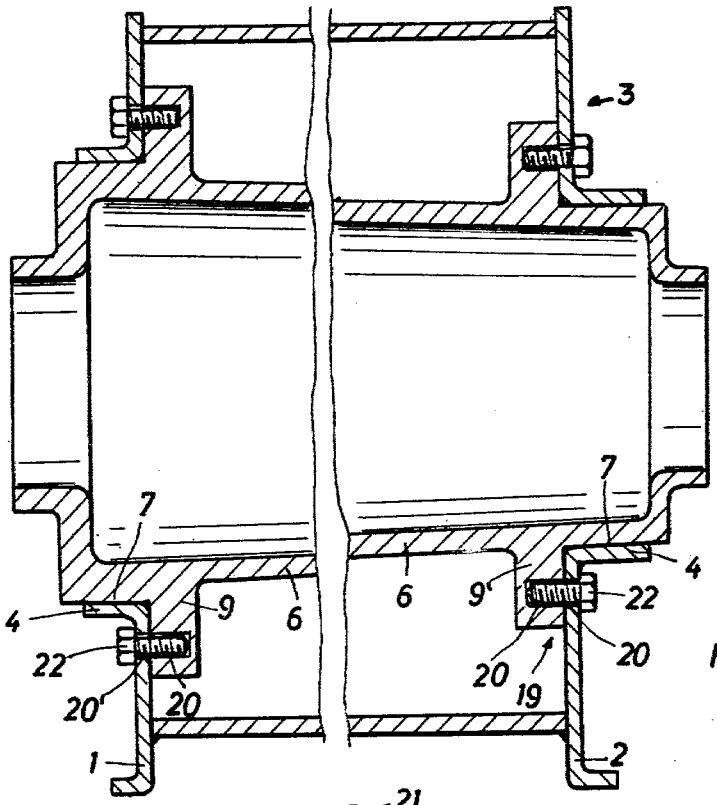
FIG. 6 is a partial section through a special form of construction.

In the Figures there are arranged in the front wall 1 and in the rear wall 2 of a sheet-steel housing 3 bent, collarshaped opening edges 4 with collar inside diameters 5, in which is installed a flame-bearing and fuel-gas-bearing installation casting 6 with front and rear seating faces 7 for pressing on the front and rear walls 1,2.

The seating faces 7 are stripped to be smooth and cylindrical and the front and rear walls 1,2 can be pressed onto the installation casting by means of a lubricant and packing agent 8.

Advantageously, front and rear stop collars 9,9' can be cast on the installation casting 6 to form gussets for the packing agent 8, but also to define an exact seat for the front and rear walls 1,2.

In the embodiment shown the installation casting 6 is made somewhat in the form of a truncated cone, the diameter ratios being selected so that the front wall 1 can be pushed with its opening edge 4 over the rear stop collar 9' and pressed onto the front seating face 7. Due to this design it is possible that the front and rear walls 1,2 can be pressed on from the same side in the same direction.

As already mentioned, the detailed design of the installation casting 6 is not to be considered limiting for the connecting arrangement. Thus, for example, the casting can be cylindrical or according to FIGS. 4,5 also oval in cross section and the outlet end 12 could terminate smooth in the same way as the burner end shown, as cover plate, necessary at the front, then having to be provided also at the rear. There could be introduced loosely on the inside of the installation casting, for example, a pot-like combination chamber 10 carried by cast-on ribs 11. The burner end and the outlet end 12 both protrude beyond their respective walls 1, 2.

FIG. 2 shows a preferred form of construction of the connecting arrangement, whereby the bent opening edge 4 is kept cylindrical and, likewise, the seating face 7, in front of which is arranged a small annular groove 13 into which engages the conically drawn-in opening edge 4' in the pressing-on operation, so that the connecting arrangement is safeguarded against internal pressure. A clamping ring 16 locked in a groove 14 holds the opening edge 4' in the annular groove 13 with the interposition of a packing ring 15. As shown in FIG. 3, the same principle of this connecting arrangement is realized correspondingly also at the burner end of the installation casting 6.

The opening edge 4' engaged into the small annular groove 13 can be fixed with a clamping ring 16 when the boiler is manufactured or, if leaks occur, with the inclusion and pressing of a packing ring 15. If, as shown in FIG. 3, a special cover ring 17 is provided for attaching the heating boiler cover (not shown), the said cover ring can be used to fix and press the clamping ring 16.

If heating boilers of this type are to be designed for larger capacities, the installation casting must be made oval in cross section, which can be realised at once from the point of view of casting, but raises difficulties in two respects regarding the use of the above-described connecting arrangement: on the one hand, oval seating faces are difficult to machine and, on the other hand, the contact pressure of the drawn-on front and rear walls on the sides is substantially smaller than at the top and bottom. Consequently, the installation casting 6' according to FIGS. 4,5 which is oval in cross section is provided with circular discs 18 on which the seating faces 7 with annular grooves 13 can be arranged and the front and rear walls 1,2 drawn on with a contact pressure equal all round.

The above-described connecting arrangement in which a liquid-tight and heat-resistant adhesive is preferably introduced between the seating faces completely satisfies tightness requirements under normal pressure conditions such as those occurring in heating systems or heating boilers.

Such adhesives are, however, sensitive to shearing, shock or impact stresses which can arise during manufacture, when, for example, the almost finished heating boilers are transported, suspended closely next to one another, on transfer lines to the next production point, whereby it is virtually impossible to prevent the heating boilers from striking one another. However, also in the pressure testing of installed heating systems which also include, of course, the heating boiler itself there occasionally occur sudden high pressure stresses in contrast to the normal operating pressures expected. Such loads which can be transmitted from the sheet-steel boiler walls into the connecting arrangement can prejudice the adhesive connection and a shift of 1 hundredth of a millimeter is enough to damage the adhesive connection and, consequently, the connecting arrangement and its tightness.

Figure 7:
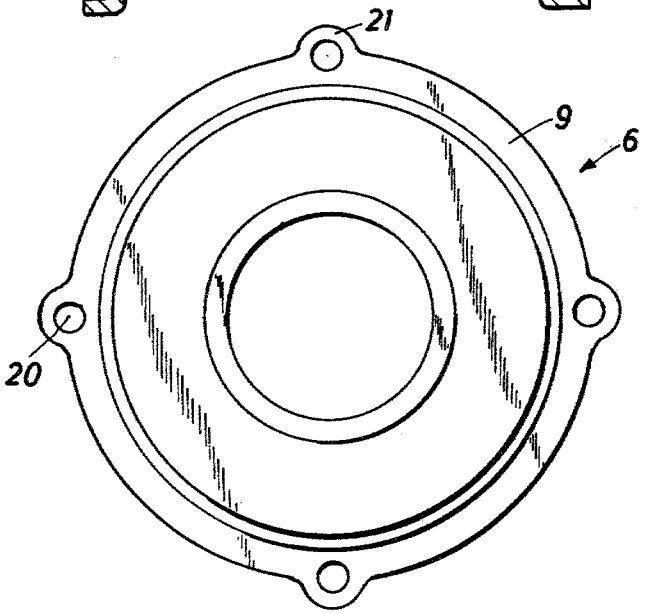
FIG. 7 is a full view of the installation casting according to FIG. 6 from the front.

This can be counteracted according to FIGS. 6,7 in a simple way by providing at least three screw connections 19 distributed over the periphery of the connecting arrangement.

This screw connection has nothing to do with a screwed flanged connection in the conventional sense, since such a connection could not satisfy with only a few screws the requisite conditions for joining the installation casting 6 to the sheet-steel housing. The screws 22 can be relatively small in the present case, since they do not have any actual connecting and sealing function.

If stop collars 9,9' are provided behind the seating faces 7 on the installation casting 6 and if they are large enough, the threaded holes 20 for the small screws 22 can be tapped directly in them. If, however, such stop collars are not present or are too small, they are advantageously cast on the installation casting 6 at corresponding points eyelets 21 which are also reworked when the seating faces 7 are stripped, so that the pressed-on front and rear walls 1,2 of the sheet-steel housing can rest closely on these eyelets 21 and can be fixed with the screws 22.

Three or four screws 22 are sufficient, as a rule, depending on the size of the installation casting 6.

This additional union also has the advantage that the heating boiler can be removed from its production apparatus before the adhesive has set and this apparatus is free again immediately.

In FIG. 6, 19 designates the special and preferred embodiment of the connecting arrangement between the front and rear walls 1,2 of sheet-steel and the installation casting 6. If the stop collars 9,9' are kept large enough, they have arranged in them the bores 20 which are aligned with corresponding bores 20' in the front and rear walls 1,2, so that these walls, if they are drawn onto the seating face 7 of the installation casting 6 with their bent opening edges 4, can be fixed immovably by means of screws 22. Instead of the collars 9,9' or on these (see FIG. 7) there can also be provided eyelets 21 which are distributed uniformly over the periphery of the connecting arrangement and in which the bores 20 are then disposed.

What is claimed is:

1. A connecting arrangement for a heating boiler of the type having a sheet-metal housing adapted for containing water and having at least front and rear sheet metal walls opposed to each other, comprising:

a first opening in said front wall;

a first sheet metal collar integral with said front wall surrounding said first opening;

a second opening in said rear wall, aligned with said first opening;

a second sheet metal collar integral with said rear wall surrounding said second opening;

an installation casting adapted for a combustion chamber and fuel gas ducts;

first and second spaced apart seating faces on said installation casting;

said first seating face being a first press fit in said first sheet metal collar;

said second seating face being a second press fit in said second sheet metal collar; and first and second ends of said installation casting extending outward a substantial distance beyond said front and rear sheet metal walls respectively.

2. Connecting arrangement according to claim 1, wherein the seating faces of the installation casting are made stripped smooth.

3. A connecting arrangement according to claim 1, further comprising:

a heat-resistant and liquid-resistant cement in at least one of said first and second press fits adapted for rigidly cementing said connecting arrangement in place; and a plurality of screws for holding the cemented press fit against displacement while said cement sets whereby damage to the tightness of said press fit due to mechanical and pressure shock is prevented.

4. A connecting arrangement according to claim 3, further comprising:

first and second stop collars cast on said installation casting adjacent said first and second seating faces;

said first and second stop collars abutting said front and rear walls; and a plurality of bores in said first and second stop collars for accommodating said plurality of screws.

5. A connecting arrangement according to claim 3, wherein said installation casting includes a plurality of eyelets cast therewith and a plurality of bores are in said plurality of eyelets for accommodating said plurality of screws.

6. A connecting arrangement according to claim 5, wherein said installation casting includes first and second stop collars cast on said installation casting adjacent said first and second seating faces and said plurality of eyelets are cast on said first and second stop collars.

7. In a connecting arrangement for a heating boiler of the type having a water-bearing sheet-steel housing having first and second walls and a casting passing through first and second aligned openings in said first and second walls of said housing wherein the improvement comprises:

(a) first and second flanges bent in the form of first and second collars in said sheet-steel housing surrounding and defining said first and second aligned openings;

(b) first and second seating faces on said casting, said first seating face fitting said first collar in a press fit, said second seating face fitting said second collar in a press fit;

(c) a first stop collar on said casting adjacent said first seating face adapted for abutting said first wall;

(d) a second stop collar on said casting adjacent said second seating face adapted for abutting said second wall; and (e) said second stop collar having a maximum dimension smaller than said first opening whereby said second stop collar passes through said first opening and engages the inside of said second wall while said first stop collar engages the outside of said first wall.

8. Connecting arrangement for a heating boiler, in whose water-bearing sheet-steel housing is arranged an installation casting consisting of a combustion chamber and fuel-gas ducts, whereby the front and rear wall of the sheet-steel housing are provided with an access opening and the opening edges are bent in the form of a collar, the inside diameter of the collar being rather smaller than the outside diameter of the seating faces of the installation casting, the front and rear wall being connected to the seating faces by a press fit, and said seating faces are provided on the end sides of the installation casting with, on the one hand, stop collars and, on the other hand, annular grooves, the opening edges of the front and rear wall engaging into the annular grooves.

9. Connecting arrangement according to claim 8, wherein said opening edges are somewhat drawn in conically in the region of the annular grooves.

10. Connecting arrangement according to claim 8, further comprising a packing ring and a clamping ring on said opening edges.

11. Connecting arrangement according to claim 10, wherein the clamping ring is arranged in an annular groove on the end side of the seating faces.

12. Connecting arrangement according to claim 11, wherein the clamping ring is held on the end side of the installation casting by means of a cover ring.

13. Connecting arrangement according to claim 12, further comprising said installation casting having an approximately oval cross section, and circular discs on the end sides of the installation casting supporting said seating faces.

* * * * *